US005146393A

United States Patent [19]

Crane

[11] Patent Number: 5,146,393

[45] Date of Patent: Sep. 8, 1992

[54] FLUORESCENT FIXTURE WITH WALL WASH FEATURE

[75] Inventor: Roy B. Crane, Wilmington, Mass.

[73] Assignee: Genlyte, Inc., Wilmington, Mass.

[21] Appl. No.: 665,283

[22] Filed: Mar. 6, 1991

[51] Int. Cl.[5] ..... F21V 7/00; F21S 3/02

[52] U.S. Cl. ..... 362/260; 362/147; 362/150; 362/346; 362/347; 362/365; 362/372

[58] Field of Search ..... 362/147, 150, 216, 217, 362/218, 220, 223, 260, 364, 365, 367, 372, 346, 347

[56] References Cited

U.S. PATENT DOCUMENTS

| | | | |
|---|---|---|---|
| 4,027,151 | 5/1977 | Barthel | 362/217 |
| 4,204,274 | 5/1980 | Luderitz | 362/220 |
| 4,517,631 | 5/1985 | Mullins | 362/346 |
| 4,519,019 | 5/1985 | Hall | 362/218 |
| 4,716,504 | 12/1987 | Pohl et al. | 362/150 |
| 4,748,543 | 5/1988 | Swarens | 362/260 |
| 4,947,292 | 8/1990 | Vlah | 362/346 |
| 4,998,188 | 3/1991 | Degelmann | 362/147 |
| 5,086,375 | 2/1992 | Fabbri et al. | 362/147 |

*Primary Examiner*—Ira S. Lazarus

*Assistant Examiner*—Y. Quach

*Attorney, Agent, or Firm*—Kane, Dalsimer, Sullivan, Kurucz, Levy, Eisele and Richard

[57] ABSTRACT

A fluorescent light fixture is provided to illuminate a rearwardly adjacent wall. An upper reflector reflects light from a forwardly offset fluorescent light bulb in a downwardly and rearwardly oblique direction to illuminate lower areas of the rearwardly adjacent wall. A lower reflector with an upper edge directed substantially toward a central portion of the fluorescent light bulb reflects light substantially horizontally to illuminate uppermost area of the rearwardly adjacent wall where the wall abuts the ceiling. A throttle plate controls the amount of lamp exposed to the lower reflector for intensity control. A glossy white series of reflective surfaces approximating an involute curve gathers output from the fluorescent light bulb for redirection from the specular portion of the upper reflector without hot spots or striping on the wall. The lamp is rotationally positioned to maximize the amount of output controlled by the optic system. A vertically adjustable mounting plate adapted to conventional grid-type ceilings formed by ceiling member rails is provided.

18 Claims, 3 Drawing Sheets

FLUORESCENT FIXTURE WITH WALL WASH FEATURE

BACKGROUND OF THE INVENTION

1. Field of Invention

This invention relates to a fluorescent light fixture which projects light to the side of the fixture throughout a range of angles which includes the direction substantially parallel to the horizontal face of the fixture and to the ceiling. This allows a ceiling-mounted fixture to illuminate an adjacent wall including the area of the wall which abuts the ceiling.

2. Description of the Prior Art

The use of fluorescent light fixtures is well-known as are the advantages thereof over incandescent fixtures. These advantages include energy efficiency and reduced maintenance requirements. However, the typical fluorescent light fixture projects downwardly throughout a range centered about a line perpendicular from the horizontal face of the fixture. This configuration is deficient for some retail merchandising or industrial applications wherein it is desireable to direct light at a wall which is perpendicular to the ceiling upon which the fluorescent fixture is mounted. An example of prior art which partially illuminates adjacent walls is U.S. Pat. No. 4,748,543 to Swarens. However, the prior art attempts to design such a fixture, such as the above-identified Swarens reference, have resulted in illumination throughout a range which does not include an angle parallel to the exposed horizontal face of the fixture. Therefore, these prior art attempts have not illuminated the adjacent wall, including the uppermost area of the wall which abuts the ceiling, evenly.

OBJECTS AND SUMMARY OF THE INVENTION

It is therefore an object of this invention to provide a fluorescent light fixture which directs light substantially to the side of the fluorescent light fixture.

It is therefore a further object of this invention to provide a ceiling-mounted fluorescent light fixture which directs light to an adjacent wall for merchandising, industrial or similar applications.

It is therefore a still further object of this invention to provide a ceiling-mounted fluorescent light fixture which directs light to the side of the fixture throughout a range of angles which includes the direction parallel to the horizontal face of the fixture and to the ceiling thereby illuminating the uppermost area of an adjacent wall which abuts the ceiling.

It is therefore a still further object of this invention to provide a ceiling-mounted fluorescent light fixture which is easily mounted on a conventional grid-type ceiling formed by inverted T-shaped rails, and adjustable to other rail shapes.

These and other objects are attained by a fluorescent light fixture with a laterally offset fluorescent bulb, preferably a U-shaped bulb such as a BIAX bulb. The light from the fluorescent bulb is reflected by an upper reflector and a lower reflector. The upper reflector is oriented so as to reflect light principally in a downwardly oblique direction toward the lower area of an adjacent wall. The lower reflector is oriented so that an edge thereof is directed toward the interior portion of the fluorescent bulb. This orientation along with the concave shape of the lower reflector causes light to be reflected at angles progressively approaching a path parallel to the exposed horizontal face of the fluorescent fixture and to the ceiling so as to illuminate the uppermost area of the adjacent wall which abuts the ceiling.

The fluorescent light fixture mounts on a conventional grid-type ceiling formed by inverted T-shaped rails as is well-known in the prior art. However, as the alignment of the front exposed horizontal face with the ceiling is critical so as to illuminate the uppermost area of the adjacent wall which abuts the ceiling, the mounting plates which engage the inverted T-rails are vertically adjustable.

BRIEF DESCRIPTION OF THE DRAWINGS

Further objects and advantages of the invention will become apparent from the following description and claims, and from the accompanying drawings, wherein:

FIGS. **4*a*–4*c*** illustrate the slot grid, narrow grid and standard grid inverted T-shaped rails, respectively.

Figure 5:
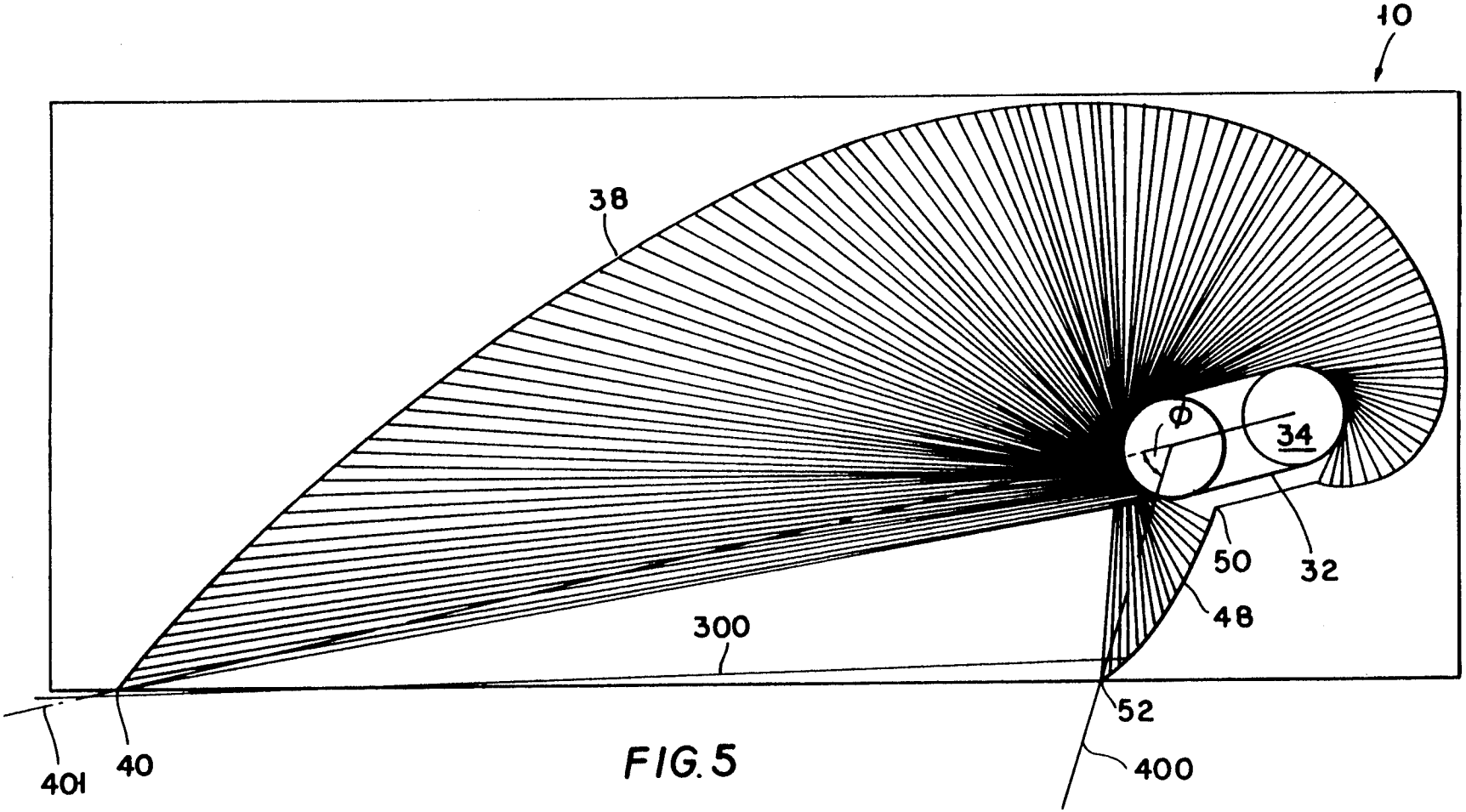

FIG. 5 illustrates a computer-generated model for the near optimum reflection of light according to the present invention.

DETAILED DESCRIPTION OF THE PREFERRED EMBODIMENT

Figure 1:
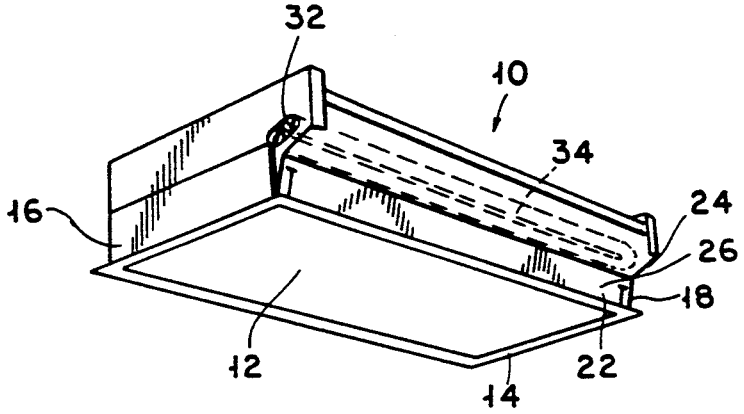
FIG. 1 is a perspective view, partially in phantom, of the exterior of the fluorescent light fixture of the present invention.
Figure 2:
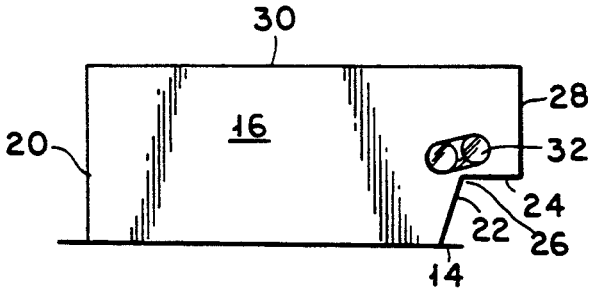
FIG. 2 is a plan view of the end of the fluorescent light fixture of the present invention.

Referring now to the drawings in detail wherein like numerals indicate like elements throughout the several views, FIG. 1 discloses a perspective view of the exterior of the fluorescent light fixture 10 while FIG. 2 discloses a plan view of an end of fluorescent light fixture 10.

Fluorescent light fixture 10 includes a lower exposed horizontal face 12, which is preferably open but may include a transparent or translucent cover, through which light passes. Horizontal face 12 is surrounded by frame 14. Sidewalls 16, 18, and rear wall 20 rise vertically from frame 14. Indented wall 22 rises at an obtuse angle from frame 14. Lower oblique surface 46 projects outwardly from indented wall 22 at an obtuse angle thereby forming longitudinal indentation 26. Front wall 28 rises vertically from a forward end of lower oblique surface 46. Top 30 is formed above sidewalls 16, 18, rear wall 20 and front wall 28.

Offset to the forward end of sidewall 16 is fluorescent socket 32 which engages U-shaped fluorescent bulb 34 (preferably a BIAX or similar bulb). Typically, fluorescent fixture 10 as measured from the exterior portion of sidewall 16 to sidewall 18 is 23⅜ inches. A standard 22¼ inch bulb is ideal for this application.

Ballast 36 is located at the intersection of rear wall 20 and top 30 and is in electrical communication with fluorescent socket 32. Rear wall 20 includes at least one aperture (not shown) into which external electrical wires (not shown) pass.

Upper concave reflector 38, passes in an arcuate shape from a lower edge 40 proximate to frame 14 inwardly adjacent to the lower section of rear wall 20 upwardly to upper oblique surface 44. Upper oblique surface 44 is formed inwardly from the intersection of top 30 and front wall 28. Similarly, lower oblique surface 46 is formed inwardly from the intersection of front wall 28 and indented wall 22. Inward forward face 45 of front wall 28 is between upper oblique surface 44 and lower oblique surface 46. Upper concave reflector 38 is preferably formed of non-iridescent specular aluminum laminate while upper oblique surface 44, inward forward face 45 and lower oblique surface 46 are preferably formed of glossy white enamel or other suitable materials well-known to those skilled in the art. This configuration prevents light striping patterns from secondary lamp imaging. Upper concave reflector 38 is fashioned as an ellipsoidal section with a second focus directed at the base of the adjacent wall whereas inward forward face 45 and oblique surfaces 44, 46, are fashioned to approximate a spiral or segment of an involute of a circle shape such as is illustrated in FIG. 5. Indeed, some applications may substitute the upper reflector shape shown in FIG. 5 for the approximation shown in FIG. 3. However, the shape of the lower concave reflector 48 in the preferred embodiment of FIG. 3 does not substantially deviate from the theoretical shape illustrated in FIG. 5. Upper concave reflector 38, in conjunction with inward forward face 45 and oblique surfaces 44, 46 reflect light from fluorescent bulb 34 principally in a downwardly oblique direction toward lower areas of a wall rearwardly adjacent to fluorescent light fixture 10.

Lower concave reflector 48, of similar material as upper concave reflector 38, is formed inwardly adjacent from indented wall 22. Lower concave reflector 48 is ellipsoidal with a second focus immediately below lower edge 40 of upper concave reflector 38. The upper edge 50 of lower concave reflector 48 forms an intersection with lower oblique surface 46 and is directed toward the interior portion of fluorescent bulb 34. This configuration limits the amount of light from fluorescent bulb 34 which is directed to lower concave reflector 48. Additionally, fluorescent socket 32 may be rotatable to allow for adjustment of the amount of light directed from fluorescent bulb 34 to lower concave reflector 48. The lower edge 52 of lower concave reflector 48 meets exposed horizontal face 12. Lower concave reflector 48 collects light, sometimes through multiple reflections from the various reflective surfaces, from fluorescent bulb 34 and directs the light through a range of angles substantially including the horizontal from lower edge 52 of lower concave reflector 48 to immediately below lower edge 40 of upper concave reflector 38, continuing substantially horizontally to illuminate the upper area of a wall (rearward from fluorescent light fixture 10) which abuts the ceiling 200 as illustrated by ray 300 in FIG. 5. Moreover, the amount of light directly emanating from fluorescent bulb 34 to the adjacent wall (not shown) is limited by angle $\Phi$ between lines 400 and 401 shown in FIG. 5.

Preferably, fluorescent light fixture 10 is mounted on a conventional grid-type ceiling formed by ceiling member rails 100. However, the vertical alignment of horizontal face 12 of fluorescent light fixture 10 is critical to light the upper areas of the adjacent wall (not shown) properly. Therefore, mounting plate 54 includes stair-shaped apertures 56, 58 through which bolts (such as illustrated by element 60 in FIGS. 4*a*–4*c*) pass at selected locations to engage apertures selected from 61–66 in sidewall 16. The selection of the apertures 61–66 and the position in stair-shaped apertures 56, 58 through which the bolts pass are dictated by the height of ceiling member rails 100 and the desired alignment with the ceiling 200.

Figure 3:
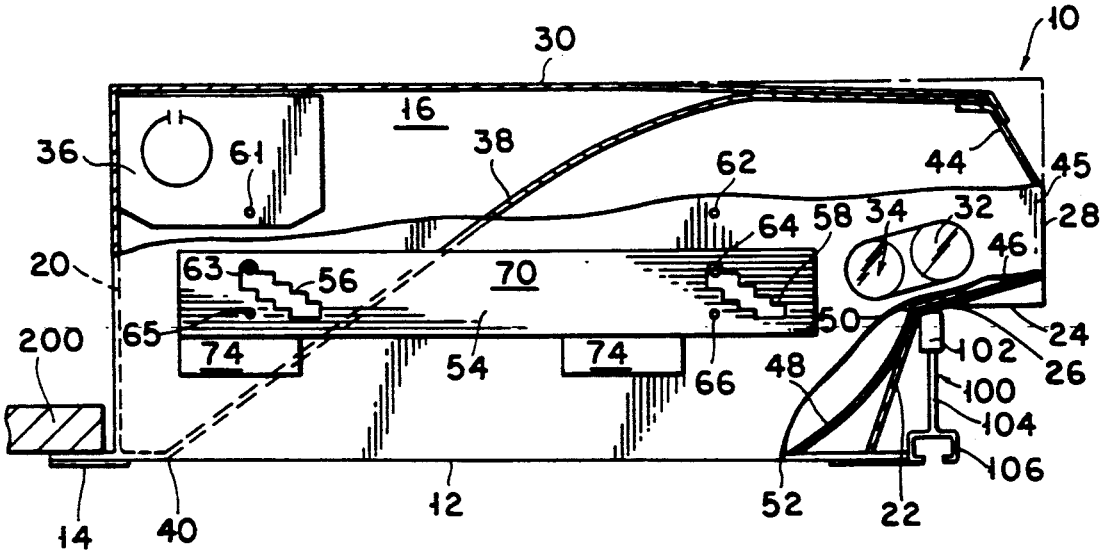
FIG. 3 is a plan view, partially in cross-section, of the end of the fluorescent light fixture of the present invention, including the vertically adjustable mounting plate for mounting the fluorescent light fixture on a grid of rails of various sizes and shapes.

Additionally, as shown in FIG. 3, longitudinal indentation 26 may rest on a ceiling member rail 100. However, this requires that the ceiling member rail 100 be of the proper height so as to not maladjust the vertical alignment of fluorescent fixture 10.

Figure 4A:
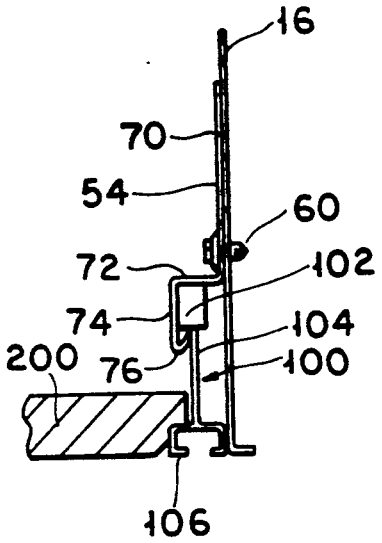
Figure 4B:
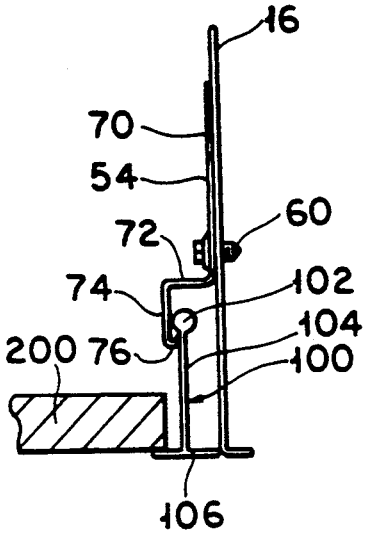
Figure 4C:
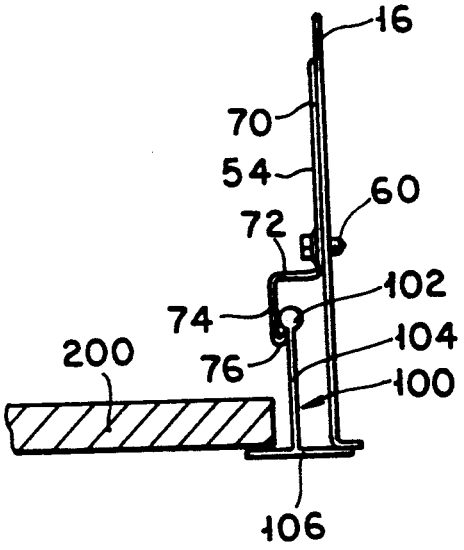

As shown in FIGS. 4*a*–4*c*, mounting plate 54 includes surface 70 through which stair-shaped apertures 56–58 pass and which is flush with sidewall 16 (or other exterior vertical walls). Bolt 60 secures mounting plate 54 to flush surface 70. Mounting plate 54 further includes horizontal spacer plate 72 extending from mounting plate 54 to offset vertical plate 74. The lower end of offset vertical plate 74 includes inwardly extending hook 76 which engages upper bulbous portion 102 of ceiling member rail 100. The three ceiling member rails 100 of FIGS. 4*a*–4*c* all include upper bulbous portion 102, stem 104 and lower horizontal crossbar 106 (FIG. 4*b* differs from 4*c* in that lower horizontal crossbar 106 in FIG. 4*c* partially supports sidewall 16).

Fluorescent fixture 10 is mounted on a conventional grid-type ceiling formed by ceiling member rails 100 in a conventional fashion as shown in FIGS. 4*a*–4*c* after adjustment of mounting plate 54 as previously described. The length of the opening required in the ceiling 200 is substantially equal to the length of fluorescent fixture 10 while the width of the opening required is from lower edge 52 of lower concave reflector 48 to lower edge 40 of upper concave reflector 38.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A fluorescent light fixture for illuminating an upper area of an adjacent vertical surface, comprising:

a body including a longitudinal axis;

a fluorescent light means including a fluorescent light bulb means;

an upper reflector including at least a portion above said fluorescent light means oriented to reflect light emanating from said fluorescent light bulb means in principally a preselected downwardly oblique direction whereby said upper reflector illuminates a lower area of the adjacent vertical surface;

a lower reflector including at least a portion below said fluorescent light means, said lower reflector including an upper edge directed substantially toward an interior section of said fluorescent light bulb means, whereby said lower reflector reflects substantially horizontally a first portion of light emanating directly from said fluorescent light bulb means in a plane perpendicular to said adjacent vertical surface and a second portion of light reflected from said upper reflector to illuminate the upper area of the adjacent vertical surface.

2. The fluorescent light fixture of claim 1 wherein said fluorescent light bulb means is offset from said longitudinal axis of said body.

3. The fluorescent light fixture of claim 2 wherein at least a portion of said upper reflector is concave.

4. The fluorescent light fixture of claim 3 wherein said upper reflector includes interior surfaces of said body.

5. The fluorescent light fixture of claim 3 wherein an upper portion of said upper reflector has a shape substantially of a portion of an involute of a circle and a lower portion of said upper reflector has a shape substantially of an ellipsoidal section with a focus at the lower area of the adjacent vertical surface.

6. The fluorescent light fixture of claim 5 wherein said fluorescent light bulb means includes a U-shaped fluorescent bulb with two parallel legs, wherein only a first of said parallel legs is oriented to shine directly on said adjacent vertical surface.

7. The fluorescent light fixture of claim 3 wherein at least a portion of said lower reflector is concave.

8. The fluorescent light fixture of claim 7 wherein said upper reflector and said lower reflector are substantially specular.

9. The fluorescent light fixture of claim 7 wherein said lower reflector and a lower portion of said upper reflector are comprised of a highly polished specular mirror finish and a segment adjacent to an upper portion of said upper reflector is comprised of highly reflective glossy white enamel.

10. A fluorescent light fixture for illuminating an upper area of an adjacent vertical surface, comprising:

a body including a longitudinal axis;

a fluorescent light means including a fluorescent light bulb means offset from said longitudinal axis of said body;

an upper reflector including at least a portion above said fluorescent light means oriented to reflect light emanating from said fluorescent light bulb means in principally a preselected downwardly oblique direction whereby said upper reflector illuminates a lower area of the adjacent vertical surface, at least a portion of said upper reflector being concave;

a lower reflector including at least a portion below said fluorescent light means, said lower reflector including at least a portion which is concave and further including an upper edge directed substantially toward an interior section of said fluorescent light bulb means, whereby said lower reflector reflects substantially horizontally a first portion of light emanating directly from said fluorescent light bulb means in a plane perpendicular to said adjacent vertical surface and a second portion of light reflected from said upper reflector to illuminate the upper area of the adjacent vertical surface; and a vertical adjustment means attached to said body;

wherein said upper reflector and said lower reflector are substantially specular.

11. The fluorescent light fixture of claim 10 wherein said vertical adjustment means includes a mounting plate for a conventional grid-type ceiling formed by ceiling member rails.

12. The fluorescent light fixture of claim 11 wherein a lower portion of said body includes a longitudinal indentation substantially below said fluorescent light bulb means.

13. The fluorescent light fixture of claim 12 wherein said fluorescent light bulb means is U-shaped.

14. The fluorescent light fixture of claim 13 wherein said fluorescent light bulb means includes a U-shaped fluorescent bulb with two parallel legs.

15. The fluorescent light fixture of claim 14 wherein said fluorescent light bulb means is offset from said longitudinal axis of said body in a direction substantially opposite from said preselected downwardly oblique direction.

16. The fluorescent light fixture of claim 15 wherein said longitudinal indentation forms a support means for said fluorescent light fixture.

17. The fluorescent light fixture of claim 16 wherein said vertical adjustment means includes stair-shaped apertures in said mounting plate which align with apertures in said body.

18. The fluorescent light fixture of claim 12 further including a lower oblique surface above said longitudinal indentation which obscures at least a portion of light from said fluorescent light bulb means from reaching said lower concave reflector thereby limiting the amount of light which is reflected by said lower concave reflector to the upper area of the adjacent vertical surface.

* * * * *